US009601089B2

(12) United States Patent
Choi

(10) Patent No.: US 9,601,089 B2
(45) Date of Patent: Mar. 21, 2017

(54) DISPLAY DEVICE WITH TIMING CONTROLLER CONNECTED TO SOURCE DRIVE INTEGRATED CIRCUIT BY A PAIR OF BIDIRECTIONAL TRANSMISSION LINES, AND DRIVING METHOD THEREOF

(71) Applicant: Samsung Display Co., Ltd., Yongin (KR)

(72) Inventor: Won-Tae Choi, Yongin (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 142 days.

(21) Appl. No.: 14/587,518

(22) Filed: Dec. 31, 2014

(65) Prior Publication Data

US 2015/0243254 A1 Aug. 27, 2015

(30) Foreign Application Priority Data

Feb. 25, 2014 (KR) ..... 10-2014-0021784

(51) Int. Cl.
*G09G 5/18* (2006.01)
*G09G 3/3225* (2016.01)
*G09G 3/32* (2016.01)

(52) U.S. Cl.
CPC ..... *G09G 5/18* (2013.01); *G09G 3/3225* (2013.01); *G09G 2300/0426* (2013.01);
(Continued)

(58) Field of Classification Search
CPC ..... G09G 3/3225; G09G 5/18; G09G 2300/0426; G09G 2310/0278;
(Continued)

(56) References Cited

U.S. PATENT DOCUMENTS 8,035,662 B2 10/2011 Yajima et al.
2007/0063942 A1 3/2007 Itoigawa
(Continued)

FOREIGN PATENT DOCUMENTS

JP 2005010194 A 1/2005
KR 20010061844 A 7/2001
(Continued)

OTHER PUBLICATIONS

M.Park, et al., "43.3: Distinguished Paper: An Advanced Intra-Panel Interface (AiPi) with Clock Embedded Multi-Level Point-to-Point Differential Signaling for Large-Sized TFT-LCD Applications," SID 06 Digest, 2006, p. 1502-1505.

*Primary Examiner* — Larry Sternbane
(74) *Attorney, Agent, or Firm* — Cantor Colburn LLP

(57) ABSTRACT

A display device includes a display panel including data lines, scan lines, and pixels connecting with the data lines and the scan lines, a scan driver configured to supply scan signals to the scan lines, a source drive integrated circuit ("IC") configured to convert digital video data into data voltages and to supply the data voltages to the data lines, and a timing controller configured to transmit the digital video data to the source drive IC and to control driving timing of the scan driver and the source drive IC, in which a transmitter and a receiver of the source drive IC are connected via a pair of transmission lines to a transmitter and a receiver of the timing controller.

23 Claims, 2 Drawing Sheets

(52) U.S. Cl.
CPC . *G09G 2310/0278* (2013.01); *G09G 2310/08* (2013.01); *G09G 2330/026* (2013.01)

(58) Field of Classification Search
CPC ..... G09G 2310/08; G09G 2330/026; G09G 3/3688; G09G 2310/0286; G09G 5/003
See application file for complete search history.

(56) References Cited

U.S. PATENT DOCUMENTS

| | | | | |
|---|---|---|---|---|
| 2009/0051675 | A1 | 2/2009 | Huang | |
| 2010/0260296 | A1* | 10/2010 | Chorney | H04L 25/0262 375/357 |
| 2011/0234318 | A1 | 9/2011 | Abugharbieh et al. | |
| 2014/0078133 | A1* | 3/2014 | Lee | G09G 3/2092 345/213 |
| 2014/0185169 | A1* | 7/2014 | Jung | G02F 1/136204 361/56 |

FOREIGN PATENT DOCUMENTS

| | | | | | |
|---|---|---|---|---|---|
| KR | 1020060078591 | A | | 7/2006 | |
| KR | 100917971 | B1 | | 9/2009 | |
| KR | 1020110094839 | A | | 8/2011 | |
| KR | 101151798 | B1 | | 5/2012 | |
| KR | 1020120051239 | A | | 5/2012 | |
| KR | 1020130020073 | A | * | 2/2013 | G09G 3/36 |
| KR | 101263185 | A | | 5/2013 | |

* cited by examiner

DISPLAY DEVICE WITH TIMING CONTROLLER CONNECTED TO SOURCE DRIVE INTEGRATED CIRCUIT BY A PAIR OF BIDIRECTIONAL TRANSMISSION LINES, AND DRIVING METHOD THEREOF

This application claims priority to Korean Patent Application No. 10-2014-0021784, filed on Feb. 25, 2014, and all the benefits accruing therefrom under 35 U.S.C. §119, the content of which in its entirety is herein incorporated by reference.

BACKGROUND

1. Field

Exemplary embodiments of the invention relate to a display device and a method of driving the display device.

2. Description of the Related Art

There has been an increasing demand for a display device for displaying an image with the growth of an information-oriented society. Recently, various types of flat panel display ("FPD") having light weight and a thin thickness, for example, a liquid crystal displays ("LCD"), an organic light emitting displays ("OLED") and a field emission display devices, has been developed.

Such a display device includes a display panel that includes a plurality of pixels provided in an active region to display an image, and a display-panel driver that drives the display panel. The display-panel driver typically includes a data driver, a scan driver, and a timing controller. The data driver may include a source drive integrated circuit ("IC") to supply data voltage to pixels of the display panel. The scan driver is configured to supply scan signals to select pixels to which the data voltage is to be supplied. The timing controller is configured to control the operation timing of the data driver and the scan driver.

The timing controller transmits digital video data to the source drive IC of the data driver using a plurality of data transmission lines, e.g., a pair of data transmission lines. Further, the source drive IC may sense information of the display panel via a predetermined sensing line. When the information of the display panel sensed by the source drive IC is transmitted to the timing controller, the timing controller analyzes the state of the display panel using the information of the display panel, and converts the digital video data based on a result of the analysis, thus improving image quality.

SUMMARY

To transmit information sensed from a display panel, another data transmission line is typically provided to allow the source drive IC to transmit predetermined data to the timing controller. However, the addition of the data transmission line leads to an increase in noise and power consumption. Further, the addition of the data transmission line may increase the size of a non-display region of the display panel.

Exemplary embodiments of the invention provide a display device which is configured such that a timing controller and a source drive IC exchange data bi-directionally using a pair of data transmission lines, and a method of driving the display device.

An exemplary embodiment of the invention provides a display device, including a display panel including data lines, scan lines, and pixels connecting with the data lines and the scan lines; a scan driver configured to supply scan signals to the scan lines; a source drive integrated circuit ("IC") configured to convert digital video data into data voltages and to supply the data voltages to the data lines; and a timing controller configured to transmit the digital video data to the source drive IC and to control driving timings of the scan driver and the source drive IC, where a transmitter and a receiver of the source drive IC are connected to a transmitter and a receiver of the timing controller via a pair of transmission lines.

Another exemplary embodiment of the invention provides a method of driving a display device including a display panel which includes data lines, scan lines, and pixels connected to the data lines and the scan lines, the method including supplying scan signals to the scan lines using a scan driver of the display device; converting digital video data into data voltages and supplying the data voltages to the data lines using a source drive IC of the display device; and transmitting the digital video data to the source drive IC and controlling drive timings of the scan driver and the source drive IC using a timing controller of the display device, where a transmitter and a receiver of the source drive IC are connected to a transmitter and a receiver of the timing controller via a pair of transmission lines.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
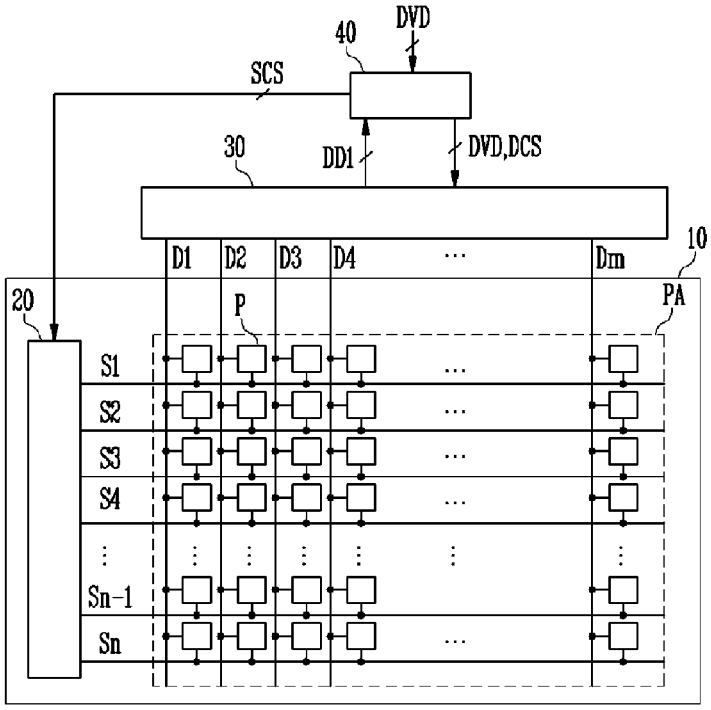
FIG. 1 is a block diagram illustrating an exemplary embodiment of a display device according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

Hereinafter, exemplary embodiments of the invention will be described in detail with reference to the accompanying drawings.

FIG. 1 is a block diagram illustrating an exemplary embodiment of a display device a display device according to the invention. An exemplary embodiment of the display device according to the invention may be one of various types of display device, such as a liquid crystal display, a field emission display, a plasma display panel, or an organic light emitting display device, for example. Hereinafter, exemplary embodiments where the display device is an organic light emitting display device will be described for convenience of description, but the invention is not limited thereto or thereby.

Referring to FIG. 1, an exemplary embodiment of the display device according to the invention includes a display panel 10, a scan driver 20, a data driver 30 and a timing controller 40.

In an exemplary embodiment, data lines D1 to Dm (here, m is a positive integer greater than 1) and scan lines S1 to Sn (here, n is a positive integer greater than 1) are disposed on a lower substrate of the display panel 10 in such a way to cross each other. A pixel array PA is disposed on the lower substrate of the display panel 10, and includes pixels P that are arranged substantially in a matrix form in a region where the data lines D1 to Dm and the scan lines S1 to Sn cross each other.

Each pixel P includes a scan transistor, a driving transistor, an organic light emitting diode, and a capacitor. Each pixel P is connected to a corresponding scan line of the scan lines S1 to Sn and a corresponding data line of the data lines D1 to Dm through the scan transistor. In one exemplary embodiment, for example, when a pixel P is connected to a j-th data line (j is a positive integer satisfying the following inequation, $1 \leq j \leq m$) and a k-th scan line (k is a positive integer satisfying the following inequation, $1 \leq j \leq m$), the scan transistor of the pixel P supplies a data voltage of the j-th data line to the pixel P in response to a scan signal of the k-th scan line. The driving transistor supplies drain-source current to the organic light emitting diode based on the voltage of the gate electrode. The organic light emitting diode emits light based on the drain-source current of the driving transistor. The capacitor maintains the voltage of the gate electrode of the driving transistor for a predetermined period of time.

In an exemplary embodiment, sensing lines may be further disposed on the lower substrate of the display panel 10 and extend substantially parallel to the data lines D1 to Dm. The sensing lines are not shown in FIG. 1 for the convenience of illustration. A first end of each sensing line may be connected to a source drive integrated circuit ("IC") 31 of the data driver 30.

A second end of each sensing line may be connected to a pixel P. In an exemplary embodiment, the source drive IC 31 of the data driver 30 may sense analog values, including current flowing in the organic light emitting diode of the pixel P or drain-source current of the driving transistor, via the sensing lines.

In an alternative exemplary embodiment, the second end of each sensing line may be connected to a sensor that is provided on the display panel 10. The sensor may include a temperature sensor for sensing a temperature in the display panel 10, a pressure sensor for sensing pressure, or an inclination sensor for sensing an inclination of the display panel 10. In such an embodiment, the source drive IC 31 of the data driver 30 may sense the analog value, sensed by the sensor, via each sensing line.

The scan driver 20 supplies the scan signal to each of the scan lines S1 to Sn of the display panel 10 in response to a scan timing control signal SCS from the timing controller 40. The scan driver 20 may sequentially supply the scan signals to the scan lines S1 to Sn of the display panel 10. The scan driver 20 may include a shift resister that sequentially generates output signals, a level shifter that converts the output signals from the shift resister into a swing width suitable for driving the transistor of the pixel, an output buffer, etc.

In an exemplary embodiment, as shown in FIG. 1, the scan driver 20 may be disposed on one side of the pixel array PA, but not being limited thereto. In an alternative exemplary embodiment, scan drivers 20 may be disposed on opposing sides of the pixel array PA. In an exemplary embodiment, gate drive ICs of the scan driver 20 may be attached to the lower substrate of the display panel 10 through a chip on glass ("COG") process. In an alternative exemplary embodiment, the scan driver 20 may be directly provided on the lower substrate of the display panel 10 simultaneously with the pixel array PA through a gate driver in panel ("GIP") process. In another alternative exemplary embodiment, the scan driver 20 may be mounted on a tape carrier package ("TCP"), and joined to the lower substrate of the display panel 10 through a tape automated bonding ("TAB") process.

The data driver 30 includes a source drive IC 31. In an exemplary embodiment, the data driver 30 includes a plurality of source ICs 31, and the data lines D1 to Dm are connected to the source drive ICs 31. The source drive IC 31 receives digital video data DVD and a data timing control signal DCS from the timing controller 40. The source drive IC 31 converts the digital video data DVD into analog data voltage in response to the data timing control signal DCS from the timing controller 40 and then supplies the converted voltage to the data lines D1 to Dm of the display panel 10. As a result, the data voltage is supplied to each of the pixels selected by the scan signal.

In an exemplary embodiment, the source drive IC 31 may include an analog to digital converter that converts the analog value sensed via each sensing line into first digital data DD1. In an alternative exemplary embodiment, the analog to digital converter that converts the analog value sensed via each sensing line into the first digital data DD1 may be provided on the display panel 10. In such an embodiment, the analog to digital converter supplies the first digital data DD1 to the source drive IC 31.

The timing controller 40 receives the digital video data DVD from a host system (not shown) through an interface, such as a low voltage differential signaling ("LVDS") interface or a transition minimized differential signaling ("TMDS") interface. The timing controller 40 receives timing signals, including a vertical sync signal, a horizontal sync signal, a data enable signal and a dot clock, for example.

The timing controller 40 generates the data timing control signal DCS for controlling the operation timing of the data driver 30, and the scan timing control signal SCS for controlling the operation timing of the scan driver 20, based on the timing signals. The timing controller 40 outputs the scan timing control signal SCS to the scan driver 20. The timing controller 40 outputs the digital video data DVD and the data timing control signal DCS to the data driver 30.

The timing controller 40 receives the first digital data DD1 from the source drive IC 31. In an exemplary embodiment, the first digital data DD1 may include information, such as a current flowing in the organic light emitting diode of the pixel P or drain-source current of the driving transistor, a temperature in the display panel 10, pressure acting on the display panel 10, and an inclined degree of the display panel 10. In such an embodiment, the timing controller 40 may apply a predetermined algorithm to the digital video data DVD based on a result obtained by analyzing the first digital data DD1, such that image quality of the display device.

Figure 2:
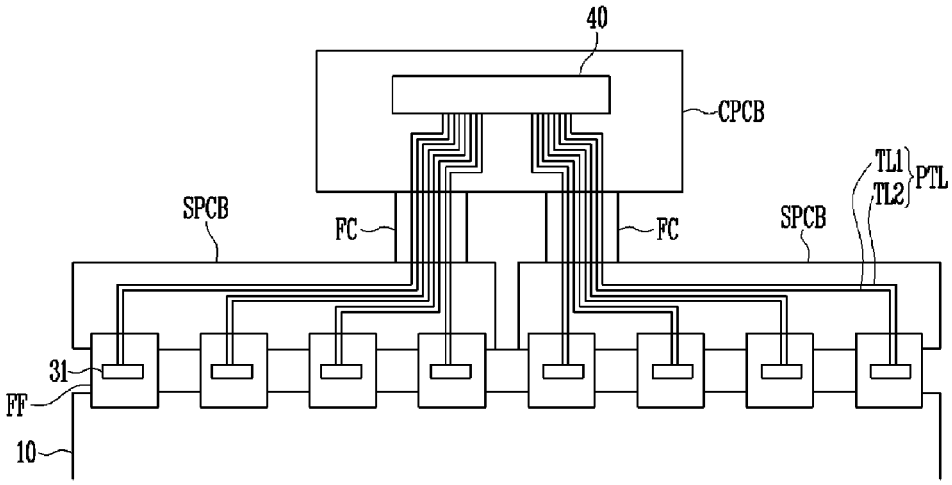
FIG. 2 is a detailed view illustrating a timing controller and source drive integrated circuits ("IC"s) shown in FIG. 1.

FIG. 2 is a detailed view illustrating the timing controller and the source drive IC of FIG. 1. In FIG. 2, the data lines D1 to Dm connected to the respective source drive ICs 31 are omitted for convenience of illustration. FIG. 2 shows an exemplary embodiment where the data driver 30 includes 8 source drive ICs, but the invention is not limited thereto. In an alternative exemplary embodiment, the data driver 30 may include one or more source drives IC, number of which is greater than or less than 8. In FIG. 2, signal lines for transmitting the data timing control signal DCS are also omitted for convenience of illustration.

Referring to FIG. 2, the source drive IC 31 is disposed, e.g., mounted, on a flexible film FF. The flexible film FF may be a chip on film ("COF"). The flexible film FF may be connected or bonded to the lower substrate of the display panel 10 and a source printed circuit board SPCB. In an exemplary embodiment, as shown in FIG. 2, the source drive IC 31 may be mounted on the flexible film FF, but the invention is not limited thereto. In an alternative exemplary embodiment, the source drive IC 31 may be directly bonded to the lower substrate of the display panel 10 through the COG process.

The timing controller 40 is disposed, e.g., mounted, on a control printed circuit board CPCB. The control printed circuit board CPCB is connected to the source printed circuit board SPCB via a flexible cable FC. The flexible cable FC may be a flexible printed circuit ("FPC").

The timing controller 40 is connected to the source drive IC 31 via a pair of transmission lines PTL. The pair of transmission lines PTL includes first and second transmission lines TL1 and TL2. The timing controller includes a plurality of transmitters and a plurality of receivers. The source drive IC includes a transmitter and a receiver. The pair of transmission lines PTL extend from the source drive ICs 31 to the timing controller 40 through the flexible film FF, the source printed circuit board SPCB, the flexible cable FC and the control printed circuit board CPCB. First ends of the pair of transmission lines PTL are connected to the transmitter and the receiver of the source drive ICs 31, and second ends of the pair of transmission lines PTL are connected to the transmitter and the receiver of the timing controller 40.

The timing controller 40 are coupled to a plurality of pairs of transmission lines PTL corresponding to the number of the source drive ICs 31. In one exemplary embodiment, for example, as shown in FIG. 2, where eight source drive ICs 31 are connected to the timing controller 40, the number of the pairs of transmission lines PTL may be eight. In such an embodiment, the timing controller 40 may include eight transmitters and eight receivers that are connected to the eight pairs of transmission lines PTL, respectively.

Hereinafter, a transmitter and a receiver of a source drive IC, and a transmitter and a receiver of the timing controller 40 connected thereto in an exemplary embodiment of a display device will be described in greater detail with reference to FIG. 3.

Figure 3:
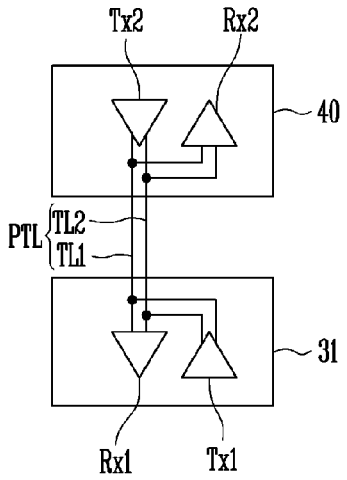
FIG. 3 is a detailed view illustrating a transmitter and a receiver of a source drive IC and a transmitter and a receiver of the timing controller connected thereto, shown in FIG. 2.

FIG. 3 is a detailed view illustrating a transmitter and a receiver of a source drive IC and a transmitter and a receiver of the timing controller connected thereto shown in FIG. 2. For convenience of illustration, FIG. 3 merely shows the transmitter Tx1 and the receiver Rx1 of one source drive IC 31, one transmitter Tx2 and one receiver Rx2 of the timing controller 40, and one pair of transmission lines PTL connected therebetween.

Referring to FIG. 3, the first end of the first transmission line TL1 of the pair of transmission lines PTL is connected to the transmitter Tx1 and the receiver Rx1 of the source drive IC 31, and the second ends of the first transmission line TL1 is connected to the transmitter Tx2 and the receiver Rx2 of the timing controller 40. In such an embodiment, the first end of the second transmission line TL2 of the pair of transmission lines PTL is connected to the transmitter Tx1 and the receiver Rx1 of the source drive IC 31, and the second end of the second transmission line TL2 is connected to the transmitter Tx2 and the receiver Rx2 of the timing controller 40.

The timing controller 40 may transmit the digital video data DVD to the source drive IC 31 through the pair of transmission lines PTL using the transmitter Tx2 thereof. The source drive IC 31 may receive the digital video data DVD from the timing controller 40 through the pair of transmission lines PTL using the receiver Rx1 thereof.

In such an embodiment, the source drive IC 31 may transmit the first digital data DD1 to the timing controller 40 through the pair of transmission lines PTL using the transmitter Tx1 thereof. The timing controller 40 may receive the first digital data DD1 from the source drive IC 31 through the pair of transmission lines PTL using the receiver Rx2 thereof.

In an exemplary embodiment, as described above, the display device includes the pair of transmission lines PTL that allows the digital video data DVD to be transmitted from the timing controller 40 to the source drive IC 31, and allows the first digital data DD1 to be transmitted from the source drive IC 31 to the timing controller 40. Accordingly, in such an embodiment of the invention, the timing controller and the source drive IC may exchange data bi-directionally using the pair of data transmission lines. In such an embodiment, a period of transmitting the digital video data DVD may be set to be different from a period of transmitting the first digital data DD1 from the source drive IC 31 to the timing controller 40. Hereinafter, such transmission periods of the digital video data DVD and the first digital data DD1 will be described in detail with reference to FIGS. 4 to 6.

Figure 4:
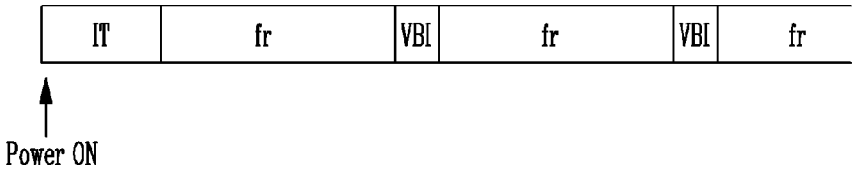
FIG. 4 is a view illustrating digital video data of the timing controller and data transmission timing of the source drive IC in an exemplary embodiment of a display device when power is applied to the display device.

FIG. 4 is a view illustrating the digital video data of the timing controller and the data transmission timing of the source drive IC in an exemplary embodiment of a display device when power is applied to the display device. Referring to FIG. 4, when power is applied to the display device, frame periods fr and vertical blank intervals VBI are repeated after an initial training period TT.

First, the timing controller 40 supplies predetermined clocks to the source drive IC 31 through the pair of data transmission lines PTL for the initial training period IT. The timing controller 40 may transmit predetermined clocks and the digital video data DVD to the source drive IC 31 in the same level, to transmit the digital video data DVD at high speed using the pair of transmission lines PTL. In such an embodiment, the source drive IC 31 performs a clock and data recovery ("CDR") function to distinguish or separate the predetermined clocks from the digital video data DVD. The initial training period IT is the period when the timing controller 40 supplies the predetermined clocks to the source drive IC 31 to perform the CDR function.

Thereafter, the timing controller 40 transmits the digital video data DVD through the pair of transmission lines PTL to the source drive IC 31 during a frame period fr, and the source drive IC 31 transmits the first digital data DD1 through the pair of transmission lines PTL to the timing controller 40 during the frame period fr. In such an embodiment, the source drive IC 31 and the timing controller 40 transmit the digital data bi-directionally based on a predetermined protocol. Such a protocol will be described later in detail with reference to FIGS. 5 and 6.

Subsequently, the timing controller 40 does not transmit the digital video data DVD through the pair of transmission lines PTL to the source drive IC 31 for a vertical blank interval VBI after the frame period fr, and the source drive IC 31 does not transmit the first digital data DD1 through the pair of transmission lines PTL to the timing controller 40 during the vertical blank interval VBI. In such an embodiment, the source drive IC and the timing controller 40 may not transmit any digital data during the vertical blank interval VBI.

In an exemplary embodiment, as described above, the timing controller and the source drive bi-directionally exchanges data using the pair of data transmission lines TPL based on a protocol for the frame period. Hereinafter, the protocol in an exemplary embodiment of the invention will be described in detail with reference to FIGS. 5 and 6.

Figure 5:
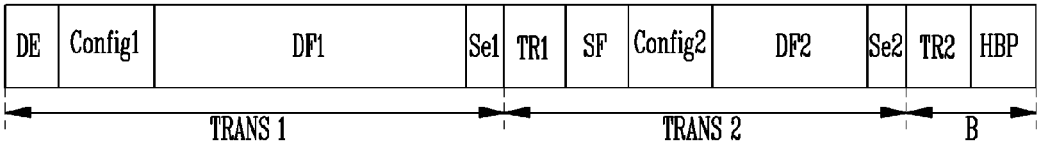
FIG. 5 is a view illustrating a protocol of an exemplary embodiment of a display device according to of the invention.

FIG. 5 is a view illustrating a protocol of an exemplary embodiment of a display device according to the invention. Referring to FIG. 5, the protocol may be divided into a first transmission period TRANS1, a second transmission period TRANS2, and a blank interval B. The first transmission period TRANS1 refers to a period when the timing controller 40 transmits data to the source drive IC 31 through the pair of transmission lines PTL. The second transmission period TRANS2 refers to a period when the source drive IC 31 transmits data to the timing controller 40 through the pair of transmission lines PTL. The blank interval B refers to an idle period when no data (e.g., the digital image data DVD and the first data DD1) is transmitted through the pair of transmission lines PTL.

The first transmission period TRANS1 includes a data enable field DE, a first array field Config1, a first data field DF1, and a first transmission end field Se1. The timing controller 40 transmits data enable information to the data enable field DE. The timing controller 40 transmits the array information of the digital video data DVD to the first array field Config1. The timing controller 40 transmits the digital video data DVD to the first data field DF1. In an exemplary embodiment, the digital video data DVD may be transmitted in 8 or 10 bit, but the invention is not limited thereto. The timing controller 40 transmits the transmission end information of the digital video data DVD to the first transmission end field Se1.

The second transmission period TRANS2 includes a first training field TR1, a synchronization field SF, a second array field Config2, a second data field DF2, and a second transmission end field Se2. The source drive IC 31 transmits the predetermined clocks to the first training field TR1 before transmitting the first digital data DD1 to the timing controller 40, to inform of the transmission of the first digital data DD1 to the timing controller 40. The source drive IC 31 transmits a synchronization clock for synchronizing thereof with another source drive IC 31 to the synchronization field SF, when the data driver 30 is provided with a plurality of source drive ICs 31. The source drive IC 31 transmits the array information of the first digital data DD1 to the second array field Config2. The source drive IC 31 transmits the first digital data DD1 to the second data field DF2. The source drive IC 31 transmits the transmission end information of the first digital data DD1 to the second transmission end field Set.

The blank interval B includes the second training field TR2 and an idle field HBP. The timing controller 40 transmits the predetermined clocks to the second training field TR2 before transmitting the digital video data DVD to the source drive IC 31, to inform of the transmission of the digital video data DVD to the source drive IC 31. The timing controller 40 transmits the predetermined clocks to the second training field TR2 of the blank interval VBI, thus allowing the digital video data DVD to be transmitted without the training field in the first transmission period TRANS1 of a next frame period. The idle field HBP corresponds to the idle period during which a transmission between the timing controller 40 and the source drive IC 31 is paused.

As described above, according to an exemplary embodiment of the invention, in one protocol, the timing controller 40 may transmit the digital video data DVD to the source drive IC 31, and the source drive IC 31 may transmit the first digital data DD1 to the timing controller 40. Consequently, in such an embodiment, the timing controller 40 and the source drive IC 31 may exchange digital data bi-directionally at high speed using the pair of transmission lines. In such an embodiment, the timing controller 40 and the source drive IC 31 may exchange digital data at high speed bi-directionally without using additional transmission lines other than the pair of transmission lines for transmitting the digital video data DVD.

According to an exemplary embodiment of the invention, the timing controller 40 applies the predetermined algorithm to the digital video data DVD based on the result obtained by analyzing the first digital data DD1, thus improving image quality of the display device.

Figure 6:
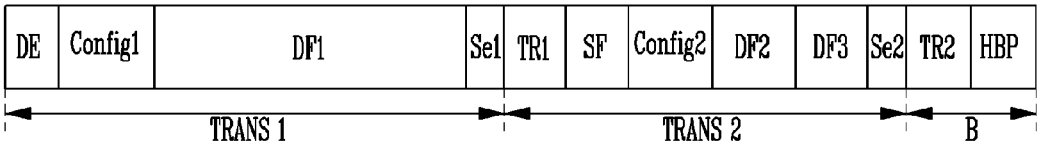
FIG. 6 is a view illustrating a protocol of an alternative exemplary embodiment of a display device according to the invention.

FIG. 6 is a view illustrating a protocol of an exemplary embodiment of a display device according to the invention. Referring to FIG. 6, the protocol may be divided into a first transmission period TRANS1, a second transmission period TRANS2, and a blank interval B. The first transmission period TRANS1 and the blank interval B of the protocol shown in FIG. 6 is substantially with the same as the first transmission period TRANS1 and the blank interval VBI of the protocol shown in FIG. 5. Thus, any repetitive detailed description of the first transmission period TRANS1 and the blank interval VBI will hereinafter be omitted.

In an exemplary embodiment, as shown in FIG. 6, the second transmission period TRANS2 includes a first training field TR1, a synchronization field SF, a second array field Config2, a second data field DF1, a third data field DF2, and a second transmission end field Se2. The source drive IC 31 transmits the predetermined clocks to the first training field TR1 before transmitting first and second digital data DD1 and DD2 to the timing controller 40, to inform of the transmission of the first and second digital data DD1 and DD2 to the timing controller 40. The source drive IC 31 transmits a synchronization clock for synchronizing thereof with another source drive IC 31 to the synchronization field SF, when the data driver 30 is provided with a plurality of source drive ICs 31. The source drive IC 31 transmits the array information of the first and second digital data DD1 and DD2 to the second array field Config2. The source drive IC 31 transmits the first digital data DD1 to the second data field DF2. The source drive IC 31 transmits the second digital data DD2 to the third data field DF3. In an exemplary embodiment, when the source drive IC 31 has no second digital data DD2 that is to be transmitted to the third data field DF3, the third data field DF3 may be an idle period. The source drive IC 31 transmits transmission end information of the first and second digital data DD1 and DD2 to the second transmission end field Se2.

As described above, according to an exemplary embodiment of the invention, in one protocol, the timing controller 40 may transmit the digital video data DVD to the source drive IC 31, and the source drive IC 31 may transmit the first and second digital data DD1 and DD2 to the timing controller 40. In such an embodiment, a plurality of pieces of digital data, e.g., the first and second digital data DD1 and DD2, may be transmitted in the second transmission period TRANS2 of the protocol. Consequently, according to an exemplary embodiment of the invention, the timing controller 40 may apply the predetermined algorithm to the digital video data DVD based on the result obtained not by a plurality of pieces of digital data DD1 and DD2, thus further improving image quality of the display device.

As set forth herein, in exemplary embodiments of the invention, the timing controller transmits the digital video data to the source drive IC, and the source drive IC transmits the first digital data to the timing controller, through a pair of transmission lines using time division for one protocol. Accordingly, in exemplary embodiments of the invention, the timing controller and the source drive IC may exchange the first digital data at high speed using the pair of transmission lines. That is, according to the embodiment of the invention, the timing controller and the source drive IC may exchange the first digital data at high speed bi-directionally without using additional transmission lines other than the pair of transmission lines provided for transmitting the digital video data DVD.

According to exemplary embodiments of the invention, the timing controller applies the predetermined algorithm to the digital video data based on the result obtained by analyzing the first digital data, thus improving image quality of the display device.

Exemplary embodiments have been disclosed herein, and although specific terms are employed, they are used and are to be interpreted in a generic and descriptive sense only and not for purpose of limitation. In some instances, as would be apparent to one of ordinary skill in the art at the time of the invention, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention as set forth in the following claims.

What is claimed is:

1. A display device, comprising:

a display panel comprising data lines, scan lines, and pixels connected to the data lines and the scan lines;

a scan driver configured to supply scan signals to the scan lines;

a source drive integrated circuit configured to convert digital video data into data voltages, and to supply the data voltages to the data lines; and a timing controller configured to transmit the digital video data to the source drive integrated circuit, and to control driving timings of the scan driver and the source drive integrated circuit, wherein a transmitter and a receiver of the source drive integrated circuit are connected to a transmitter and a receiver of the timing controller via a pair of transmission lines.

2. The display device of claim 1, wherein the timing controller transmits the digital video data to the source drive integrated circuit through the pair of transmission lines during a first transmission period of a predefined protocol, and the source drive integrated circuit transmits first digital data to the timing controller through the pair of transmission lines during a second transmission period of the predefined protocol.

3. The display device of claim 2, wherein the first transmission period comprises a data enable field, a first array field, a first data field and a first transmission end field, and the timing controller transmits data enable information to the data enable field, transmits array information of the digital video data to the first array field, transmits the digital video data to the first data field, and transmits transmission end information of the digital video data to the first transmission end field.

4. The display device of claim 2, wherein the second transmission period comprises a first training field, a synchronization field, a second array field, a second data field and a second transmission end field, and the source drive integrated circuit transmits predetermined clocks to the first training field, transmits a synchronization clock for synchronizing the source drive integrated circuit with another source drive integrated circuit to the synchronization field, transmits array information of the first digital data to the second array field, transmits the first digital data to the second data field, and transmits transmission end information of the first digital data to the second transmission end field.

5. The display device of claim 4, wherein the second transmission period further comprises a third data field between the second data field and the second transmission end field, and the source drive integrated circuit transmits second digital data to the third data field.

6. The display device of claim 4, further comprising:

an analog converter configured to sense predetermined analog values from pixels of the display panel via sensing lines disposed on the display panel, and to convert the analog values into the first digital data.

7. The display device of claim 4, further comprising:

an analog converter configured to sense predetermined analog values from a sensor disposed on the display panel via sensing lines disposed on the display panel, and to convert the analog values into the first digital data.

8. The display device of claim 2, wherein the source drive integrated circuit and the timing controller do not transmit the digital video data and the first data via the pair of transmission lines during a blank interval of the predefined protocol.

9. The display device of claim 8, wherein the blank interval of the predefined protocol comprises a second training field and an idle field, the timing controller transmits predetermined clocks in the second training field to the source drive integrated circuit, and a transmission between the source drive IC and the timing controller is paused in the idle field.

10. A method of driving a display device comprising a display panel which comprises data lines, scan lines and pixels connected to the data lines and the scan lines, the method comprising:

supplying scan signals to the scan lines using a scan driver of the display device;

converting digital video data into data voltages and supplying the data voltages to the data lines using a source drive integrated circuit of the display device; and transmitting the digital video data to the source drive integrated circuit, and controlling drive timings of the scan driver and the source drive integrated circuit using a timing controller of the display device, wherein a transmitter and a receiver of the source drive integrated circuit are connected to a transmitter and a receiver of the timing controller via a pair of transmission lines.

11. The method of claim 10, wherein the transmitting the digital video data to the source drive integrated circuit, and the controlling the drive timings of the scan driver and the source drive integrated circuit using the timing controller comprises:

transmitting the digital video data from the timing controller to the source drive integrated circuit through the pair of transmission lines during a first transmission period of a predefined protocol, and transmitting first digital data from the source drive integrated circuit to the timing controller through the pair of transmission lines during a second transmission period of the predefined protocol.

12. The method of claim 11, wherein the transmitting the digital video data from the timing controller to the source drive integrated circuit through the pair of transmission lines during the first transmission period of the predefined protocol comprises:

transmitting data enable information to a data enable field in the first transmission period;

transmitting array information of the digital video data to a first array field in the first transmission period;

transmitting the digital video data to a first data field in the first transmission period; and transmitting transmission end information of the digital video data to a first transmission end field in the first transmission period.

13. The method of claim 11, wherein the transmitting the first digital data from the source drive integrated circuit to the timing controller through the pair of transmission lines during the second transmission period of the predefined protocol comprises:

transmitting predetermined clocks to a first training field in the second transmission period;

transmitting a synchronizing clock for synchronizing the source drive integrated circuit with another source drive integrated circuit of the display device to a synchronization field in the second transmission period;

transmitting array information of the first digital data to a second array field in the second transmission period; and transmitting the first digital data to a second data field in the second transmission period, and transmitting transmission end information of the first digital data to a second transmission end field in the second transmission period.

14. The method of claim 13, wherein the transmitting the first digital data from the source drive integrated circuit to the timing controller further comprises:

transmitting second digital data to the third data field in the second transmission period.

15. The method of claim 13, further comprising:

sensing predetermined analog values from the pixels of the display panel through sensing lines disposed on the display panel, using an analog converter; and converting the analog values into the first digital data.

16. The method of claim 13, further comprising:

sensing predetermined analog values from a sensor provided on the display panel through sensing lines disposed on the display panel, using an analog converter; and converting the analog values into the first digital data.

17. The method of claim 11, wherein the transmitting the digital video data to the source drive integrated circuit, and the controlling the drive timings of the scan driver and the source drive integrated circuit using a timing controller further comprises:

stopping transmission of digital video data and the first data through the pair of transmission lines during a blank interval of the predefined protocol.

18. The method of claim 17, wherein the stopping the transmission of the digital video data and the first data through the pair of transmission lines during the blank interval of the predefined protocol comprises:

transmitting predetermined clocks in a second training field in the blank interval from the timing controller to the source drive integrated circuit; and pausing a transmission between the timing controller and the source drive IC in an idle field in the blank interval.

19. A display device comprising:

a display panel comprising data lines, scan lines and pixels connected to the data lines and scan lines;

a timing controller which receives digital video signal and timing signals from a host system and generates data timing control signal and scan timing control signal based on the timing signals;

a scan driver which receives the scan timing control signal from the timing controller and supplies scan signals to the scan lines in response to the scan timing control signal;

a source drive integrated circuit which receives the digital video signal and the data timing control signal from the timing controller, converts the digital video signal into data voltages and supplies the data voltages to the data lines in response to the data timing control signal; and a pair of transmission lines which connects a transmitter and a receiver of the source drive integrated circuit to a transmitter and a receiver of the timing controller, wherein the display panel further comprises a sensing line connected to the source drive integrated circuit and a pixel of the pixels of the display panel;

wherein an analog value sensed via the sensing line is converted into first digital data, and wherein the first digital data is transmitted from the source drive integrated circuit to the timing controller via the pair of transmission lines.

20. The display device of claim 19, wherein the source drive integrated circuit comprises an analog converter which senses the analog value from the pixel and converts the analog value into the first digital data.

21. The display device of claim 19, further comprising:

an analog converter which senses the analog value from the pixel and converts the analog value into the first digital data, wherein the analog converter is connected between the sensing line and the source drive integrated circuit.

22. The display device of claim 19, wherein the timing controller transmits the digital video data to the source drive integrated circuit through the pair of transmission lines during a first transmission period of a predefined protocol, and the source drive integrated circuit transmits the first digital data to the timing controller through the pair of transmission lines during a second transmission period of the predefined protocol.

23. The display device of claim 22, wherein the second transmission period comprises a first training field, a synchronization field, a second array field, a second data field and a second transmission end field, and the source drive integrated circuit transmits predetermined clocks to the first training field, transmits a synchronization clock for synchronizing the source drive integrated circuit with another source drive integrated circuit to the synchronization field, transmits array information of the first digital data to the second array field, transmits the first digital data to the second data field, and transmits transmission end information of the first digital data to the second transmission end field.

* * * * *